United States Patent [19]

Hsueh

[11] Patent Number: 4,941,851

[45] Date of Patent: Jul. 17, 1990

[54] FUSE HOLDER FOR FLAT-TYPE FUSE BLOCK

[76] Inventor: Fu-Cheng Hsueh, No. 1045, Jen-Ai Tsun, Jen-Te Hsiang, Tainan Hsien, Taiwan

[21] Appl. No.: 394,047

[22] Filed: Aug. 15, 1989

[51] Int. Cl.[5] ..... H01R 13/08

[52] U.S. Cl. ..... 439/621; 337/187

[58] Field of Search ..... 439/621, 622; 337/186, 337/187, 194, 201

[56] References Cited

U.S. PATENT DOCUMENTS

| | | | |
|---|---|---|---|
| 3,425,023 | 1/1969 | Krol et al. | 439/621 X |
| 4,575,704 | 3/1986 | Pezold | 439/622 X |
| 4,648,674 | 3/1987 | Sanchez | 439/622 X |
| 4,799,898 | 1/1989 | Schick | 439/621 X |
| 4,830,631 | 5/1989 | Hsuen | 439/622 |

*Primary Examiner*—Eugene F. Desmond

*Attorney, Agent, or Firm*—Limbach, Limbach & Sutton

[57] ABSTRACT

A fuse holder for receiving a flat-type fuse block includes a housing of insulating material having a bottom wall which has an intermediate first channel member extending from one end of the bottom wall to another opposite end of the bottom wall and opening at both ends of the channel member. The bottom wall has a first and a second hinged end which are opposite to each other and which extend along the direction of the first channel member. Each of a pair of female terminals has a first resilient clip portion and a second clip portion generally perpendicularly extending from the first resilient clip portion into the first channel member. A rear cover portion is hinged to the first hinged end which houses and clamps the female terminals cooperatively with the bottom wall. The rear cover portion has a second channel member which is mated with the first channel member to define a bore with two open ends forming an access to the second clip portion. A front cover portion is hinged to the second hinged end of the bottom wall which cooperatively confines, with the bottom wall, a chamber for receiving the flat body of the flat-type fuse block.

5 Claims, 4 Drawing Sheets

FUSE HOLDER FOR FLAT-TYPE FUSE BLOCK

BACKGROUND OF THE INVENTION

This invention relates to a fuse holder, and more particularly to a fuse holder for receiving a flat-type fuse block.

Referring to FIG. 1, my U.S. Pat. No. 4,830,631 has disclosed a fuse holder connected between two wires 14 which has an insulated housing 13 and a pair of female terminals 12 mounted therein for receiving a flat-type fuse 11 having two male terminals 111. This fuse holder can minimize the radial space of the connecting portions of the wires and provides a cap 133 for partially covering the flat body of the fuse block so as to prevent accidental electric shock. However, since the connector members 121 of the female terminals 12 are substantially perpendicular to the resilient clip portions 122 which receive the male terminals 111, it is very likely that the curved portions of said clip portions 122 may be damaged by a processing machine, which connects the wires and the connector member of the female terminals, when said machine presses downwardly to enable said connector members 121 to wrap around the wires 14. In addition, during assembly, the female terminals 12 are integrally formed with the housing 13 by means of injection molding accompanied by other complicated manufacturing steps.

SUMMARY OF THE INVENTION

It is therefore an object of this invention to provide a fuse holder for a flat-type fuse block which can be simply assembled.

It is another object of this invention to provide a fuse holder for flat-type fuse block which will not be damaged during the manufacturing process thereof.

Therefore, in accordance with the present invention, a fuse holder for a flat-type fuse block comprises a housing of insulating material including a bottom wall which has an intermediate first channel member extending from one end thereof to another opposite end thereof and opening at both ends thereof. The bottom wall has a first and a second hinged end, located opposite to each other, which extend along the direction of the first channel member. A pair of female terminals each having a first resilient clip portion and a second clip portion which generally perpendicularly extend from the first resilient clip portion into the first channel member. Each of the first resilient clip portions has an access opening which is directed toward the first channel member. A rear cover portion is hinged to the first hinged end which houses and clamps the female terminals cooperatively with the bottom wall when the rear cover portion is turned upward to a closed position. The rear cover portion has a second channel member which is mated with the first channel member to define a bore with two open ends forming an access to the second clip portion. A front cover portion is hinged to the second hinged end of the bottom wall which, with the bottom wall, cooperatively confines a chamber for receiving the flat body of the flat-type fuse block when the front cover portion is turned upward to a closed position. A locking means is provided on the housing for releasably locking the rear cover portion against said bottom wall when the rear cover portion is depressed against the bottom wall. The housing further has a fastening means for releasably fastening the rear and front cover portions. Whereby, in assembly, the female terminals can be incorporated into the housing by means of simply turning the rear cover portion to lock with the bottom wall of the housing. The flat-type fuse block of this invention can also be inserted into the female terminals and encased in the housing by means of turning the front cover portion to engage with the bottom wall of said housing.

In addition, each of the female terminals has an L-shaped connecting portion which extends downwardly and forwardly from the first clip portion of the female terminal to horizontally separate said first clip portion from the second clip portion which is to be connected with a pair of wires. In this way, the first clip portion which is to receive the male terminals of the flat-type fuse block, will not be damaged by a processing machine which connects the wires with the second clip portion of the female terminals.

BRIEF DESCRIPTION OF THE DRAWINGS

Other features and advantages of this invention will become apparent in following detailed description of the preferred embodiment of this invention with reference to the accompanying drawings, in which.

DETAILED DESCRIPTION OF THE PREFERRED EMBODIMENT

Figure 1:
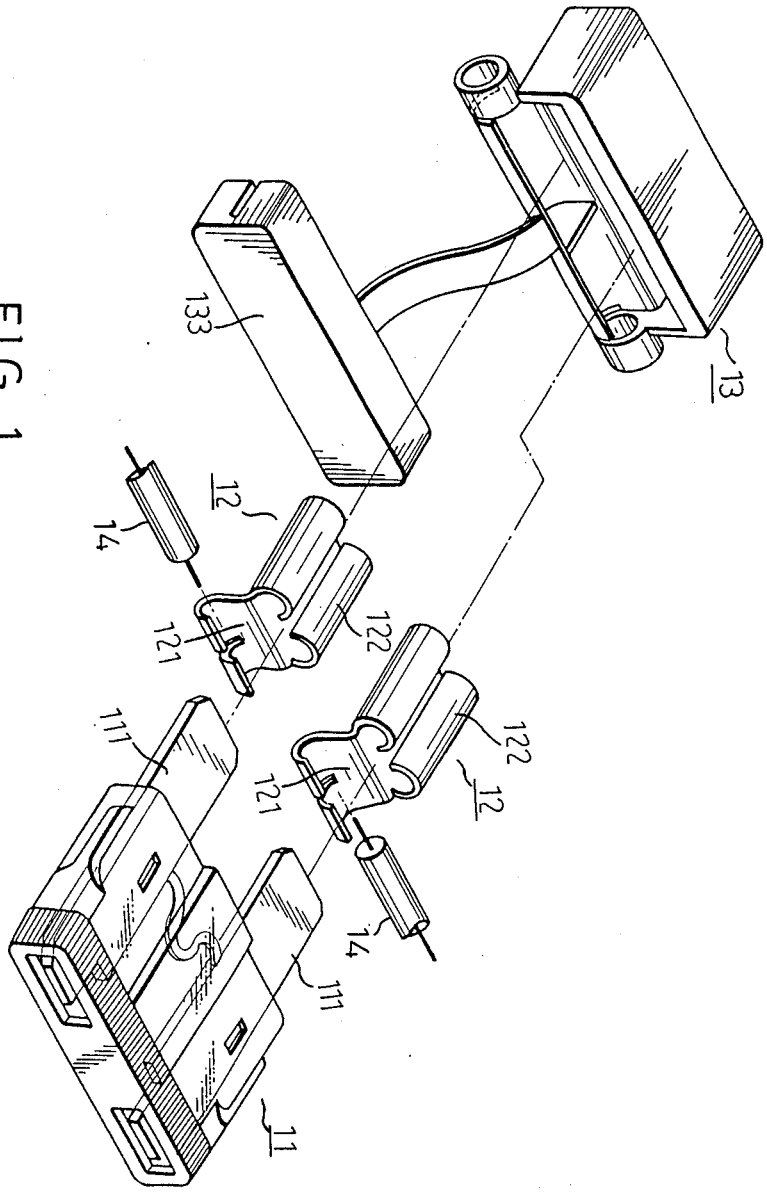
FIG. 1 (PRIOR ART)
FIG. 1 is a perspective exploded view of a conventional fuse holder for a flat-type fuse block.
Figure 2:
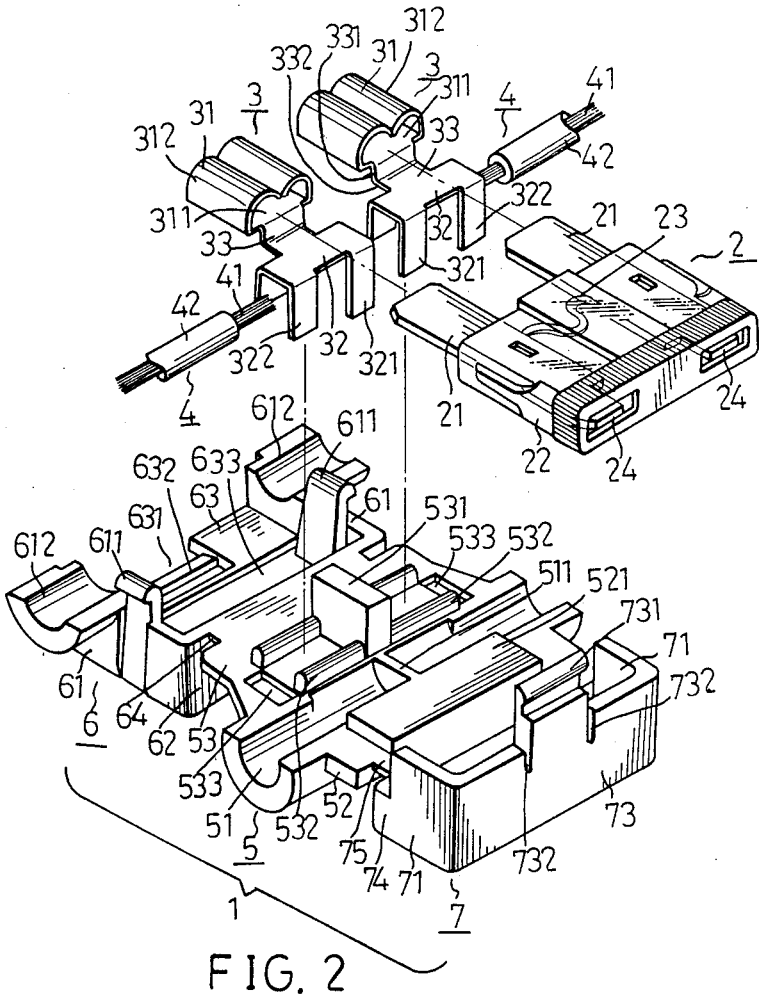
FIG. 2 is a perspective exploded view of a preferred embodiment of a fuse holder for a flat-type fuse block of this invention.

Referring to FIG. 2, a preferred embodiment of a fuse holder for receiving a flat-type fuse block 2 of this invention is shown. The fuse holder generally includes a pair of female terminals 3 and a housing 1 of insulating material for accommodating said female terminals 3 and the fuse block 2 therewithin.

The fuse holder is connected to a circuit by incoming wires 4 which place the fuse holder in a series connection. The flat-type fuse block 2 has a transparent plastic flat body 22, a fusible element 23 coupled between a pair of juxtaposed, laterally spaced co-planar, parallel and generally flat male terminals 21, which are clearly visible through the transparent body 22 to reveal the condition of the fuses, and two openings 24 formed at one side of the flat body 22 so that the male terminals 21 can be contacted by an amperemeter (not shown) for checking the condition of the fuse.

Each of the female terminals 3 has a resilient clip portion 31, an L-shaped connecting member 33 and a generally inverted U-shaped clip member 32. The first clip portion 31 has a rectangular plate 311 with two opposite curved sides 312 so as to clamp one of the male terminals 21 of the fuse block 2. The connecting member 33 has a vertical wall 331 extending downwardly from the front end of the rectangular plate 311 of the clip portion 31 and a horizontal wall 332 extending forwardly from the free edge of the vertical wall 331 which connects to the base portion of the clip member 32. The clip member 32 has two pairs of legs 321, 322 extending downwardly from the base portion thereof each pair of which has a shorter first leg 321 adapted to clamp the conductive portion 41 of the wire 4 and a longer second leg 322 adapted to clamp the surrounding insulation 42 of the wire 4. The height of the vertical wall 332 equals the vertical distance between the male terminals 21 of the fuse block 2 and the bottom wall 5 of the housing 1 when said fuse block 2 is placed on said bottom wall 5 of said housing 1. The horizontal wall 331 is used to increase the horizontal distance between said clip portions 31 and the clip members 32 so that the clip portions 31 will not be damaged when said clip members 32 are pressed to clamp the wires 4.

Figure 3:
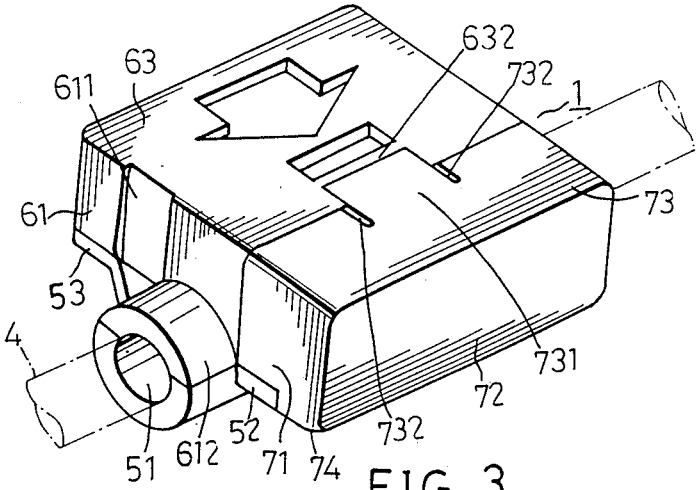
FIG. 3 is a perspective view of a preferred embodiment of a fuse holder for a flat-type fuse block of this invention.

Referring to FIG. 2 and 3, the housing 1, which is generally in the shape of a flat quadratic prism, is made of a plastic material which includes a rear cover portion 6, a bottom wall 5 and a front cover portion 7 in combination. The bottom wall 5 has an intermediate channel member 51 extending from one end thereof to another opposite end thereof and a first and a second wall portions 52, 53 extending parallelly from the opposite top side of said channel member 51. The channel member 51 of the bottom wall 5 is adapted to receive the clip members 32 of the female terminals 3. A first partition 511 is provided transversely in the channel member 51 so as to separate the two clip members 32 of the female terminals 3 from each other. A second partition 531 is provided on the second wall portion 53 of the bottom wall 5, adjacent to the channel member 51 and aligned with the first partition 521, for separating the resilient clip portions 31 of the female terminals 3 from each other. Two clip seats 532 are provided on the second wall portion 53 of the bottom wall 5 respectively at two sides of the second partition 531 which are raised, relative to the bottom wall 5, at a height generally equal to the height of the vertical wall 331 of the connecting member 33 so that the resilient clip portion 31 of the female terminals 3 can be rested thereon. A platform 521 projects from the first wall portion of 52 the bottom wall 5 so that the flat body 22 of the fuse block 2 is raised to a position where the male terminals 21 of the fuse block 2 are aligned with the clip portion 31 of the female terminals 3. Two slots 533 are provided in the second wall portion 53 respectively at two opposite sides of the second partition near the clip seats 532.

The rear cover portion 6 is confined by two first vertical walls 61, a second vertical wall 62 and a third horizontal wall 63. The top edge of the second vertical wall is hinged to the edge of the second wall portion 53 of the bottom wall 5 by means of a hinge connection 64. Two snap hooks 611 are respectively provided on the first vertical walls 61 so that engagement can be made thereby with the slots 533 formed in the bottom wall 5 when the rear cover portion 6 turns upward to lock thereagainst. The rear cover portion 6 has two second channel members 612 which cover the first channel member 51 thereby defining a bore with two open ends so as to provide an access to the clip member 32 and hold the wires 4. A notch 631 is formed on the edge remote from the hinge connection 64 having a retaining bar 632 transversely formed therein. The third horizontal wall 63 has a generally rectangular recessed portion 633 provided between the notch 631 thereof and the second vertical wall 62 for positioning the clip portions 31 of the female terminals 3 in the recessed portion 633.

The front cover portion 7 is a generally rectangular cap which is confined by a pair of third vertical walls 71, a forth vertical wall 72, a forth horizontal wall 73 and a fifth horizontal wall 74. The fifth horizontal wall 74 is hinged to the first wall portion 52 of the bottom wall 5 by means of a hinge connection 75. A snap hook 731 extends from the central portion of said forth horizontal wall 73 so as to releasably lock with the retaining bar 632. The snap hook 731 has two slits formed at opposite sides thereof so as to increase the flexibility thereof.

Figure 4:
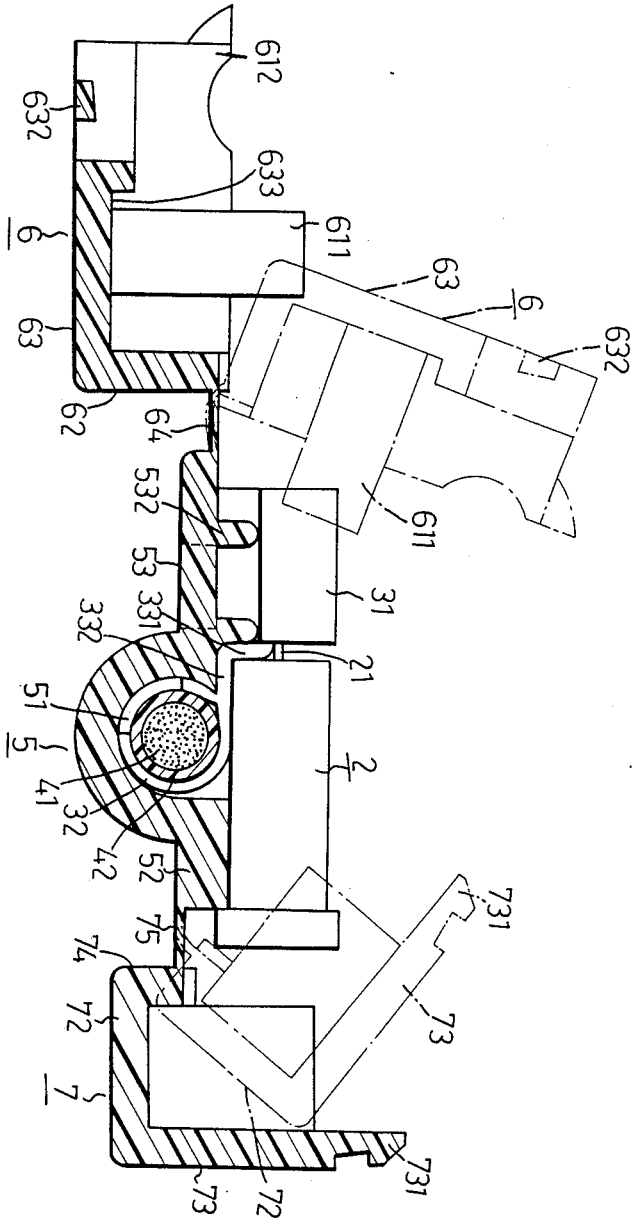
FIG. 4 is a schematic sectional view of a fuse holder for a flat-type fuse block of this invention, showing how the rear and the front cover portions of the housing are turned to engage with the bottom wall of the housing of the fuse holder.

Referring to FIG. 4, in assembling the fuse holder of this invention, first, the female terminals 3, which have two wires 4 connected thereto, are respectively engaged with the male terminals 21 of the flat-type fuse block 2. The assembled member is then placed onto the bottom wall 5. In this position, the clip members 32 are received within the first channel member 51 of the bottom wall 5 and the two resilient clip portions 31 of the female terminals 3, respectively rest on the sides of the second partition 531 and are raised parallelly by the clip seats 532.

Figure 5:
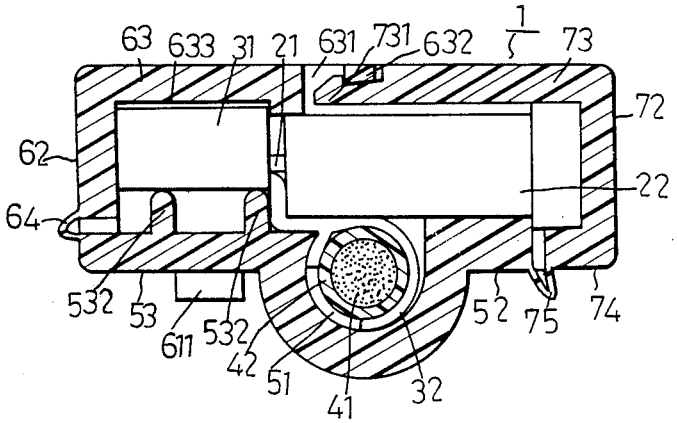
FIG. 5 is a sectional view of a preferred embodiment of an assembled fuse holder of this invention.

Referring to FIGS. 4 and 5, the rear cover portion 6 turns upward to depress the bottom wall 5 enabling the snap hooks 611 to lock with the slots 533 of the bottom wall 5 so as to confine a chamber which houses and clamps the clip portion of the female terminals 3 with the clip portions 31 which are positioned in the recessed portion 633 of the rear cover portion 6. The second channel members 612 cover the first channel member 51 to hold the wires 4 as described hereinbefore. The front cover portion 7 turns upward to abut upon the first wall portion 52 of the bottom wall 5 and confines a chamber to encase the flat body 22 of the fuse block 2. The snap hook 731 of said forth horizontal wall 73 is depressed to lock with the retaining bar 632 of the rear cover portion 6, thus forming a integral housing in the shape of a quadratic prism.

To examine the condition of the fuse in the fuse block 2, the snap hook 731 is disengaged with the retaining bar 632 and the front cover portion 7 is turned downward to separate from the bottom wall 5. Of course, if the front cover 7 is made of a transparent material, it is not necessary to open the front cover portion 7 to examine the condition of the fuses.

Figure 6:
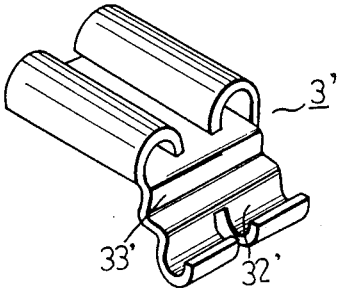
FIG. 6 is a perspective view of another type of female terminal of the fuse holder of this invention.

Referring to FIG. 6, a perspective view of a variation of the female terminal of this invention is shown. The modified female terminal 3' has a structure similar to that of the abovementioned female terminal 3 except that the clip member 32 thereof is replaced by a pair of curved clip members 32'. The curved clip members extend from the L-shaped connecting member 33' and form two hook portions with a slit formed therebetween so as to be respectively connected with the conductive portion and the surrounding insulation of one of the wires 4.

It is appreciated that the fuse holder of the present invention has the following advantages: (1) The female terminals and the fuse block can be totally enveloped by a housing which has two cover portions hinged to confine a hollow chamber that receives and securely holds the female terminals and the fuse block in position. (2) The clip portions of the female terminals are not damaged by a processing machine when said clip members are pressed by the processing machine to clamp the wires.

With this invention thus explained, it is apparent that numerous modifications and variations can be made without departing from the scope and spirit of this invention. It is therefore intended that this invention be limited only as indicated in the appended claims.

I claim:

1. A fuse holder for connecting a flat-type fuse block between a pair of wires, said flat-type fuse block having a flat plastic body, a pair of juxtaposed, laterally spaced co-planar, parallel and generally flat male terminals, and a fusible element disposed inside said flat body which interconnects said pair of male terminals, said fuse holder comprising:

a housing of insulating material including a bottom wall which has an intermediate first channel member extending from one end thereof to another opposite end thereof and opening at both ends thereof, a first partition provided transversely in said first channel member, a second partition provided on said bottom wall adjacent to said first channel member and aligned with said first partition, and two clip seats respectively provided on said bottom wall at two sides of said second partition and raised to a position relative to said first channel member, said bottom wall further having first and second hinged ends extending along the direction of said first channel member, said first hinged end being adjacent to said clip seat and opposite said second hinged end;

a pair of female terminals each of which has a first resilient clip portion placed on each of said clip seats and a second clip portion extending from said first resilient clip portion into said first channel member, each of said first resilient clip portions having an access opening which is directed toward said first channel member;

said housing further having a rear cover portion, hinged to said first hinged end, which houses and clamps said female terminals cooperatively with said bottom wall when said rear cover portion is turned upward to a closed position, said rear cover portion having a second channel member which is mated with said first channel member to define a bore with two open ends forming an access to said second clip portion;

said housing further having a front cover portion which is hinged to said second hinged end, said front cover portion cooperatively confining, with said bottom wall, a chamber for receiving said flat body of said flat-type fuse block when said front cover portion is turned upward to a closed position;

means for releasably locking said rear cover portion against said bottom wall, said locking means being interlocked when said rear cover portion is depressed against said bottom wall; and means for releasably fastening said rear and front cover portions.

2. A fuse holder as claimed in claim 1, wherein said housing is generally in the shape of a quadratic prism

3. A fuse holder as claimed in claim 1, wherein said bottom wall has a platform projecting therefrom which is adjacent said first channel member and opposite to said second partition.

4. A fuse holder as claimed in claim 1, wherein each of said second clip portions of said female terminals includes an L-shaped connecting member extending downwardly and forwardly from said first clip portion adjacent to said access opening of said first clip portion, and a clip member of generally inverted U-shaped in cross section with a base portion of said clip member joining with connecting member.

5. A fuse holder as claimed in claim 1, wherein each of said second clip portions of said female terminals includes an L-shaped connecting member extending downwardly and forwardly from said first clip portion, adjacent said access opening of said first clip portion, and an upward curving clip member extending form said connecting member for engaging one of said wires.

* * * * *